United States Patent [19]

Lieberman

[11] Patent Number: 4,817,504

[45] Date of Patent: Apr. 4, 1989

[54] OSCILLATORY ACTUATOR WITH DIRECT CONTACT SHAFT-SHOULDER TO END CAP SEAL

[75] Inventor: Walter G. Lieberman, Minneapolis, Minn.

[73] Assignee: Tol-O-Matic, Inc., Minneapolis, Minn.

[21] Appl. No.: 882,161

[22] Filed: Jul. 7, 1986

Related U.S. Application Data

[63] Continuation of Ser. No. 632,719, Jul. 20, 1984, abandoned.

[51] Int. Cl.[4] ..... F01C 9/00

[52] U.S. Cl. ..... 92/125; 92/121

[58] Field of Search ..... 92/120, 121, 122, 124, 92/125

[56] References Cited

U.S. PATENT DOCUMENTS

| | | | |
|---|---|---|---|
| 2,339,042 | 1/1944 | Anderson | 92/122 |
| 3,128,679 | 4/1964 | Trendle | 92/125 X |
| 3,131,610 | 5/1964 | Paulus | 92/125 |
| 3,359,871 | 12/1967 | Kamman | 92/121 |
| 3,528,345 | 9/1970 | Rumsey | 92/120 X |
| 4,474,105 | 10/1984 | Eicher et al. | 92/122 |
| 4,495,856 | 1/1985 | Sollami | 92/125 |
| 4,565,119 | 1/1986 | Higuchi | 92/121 X |

FOREIGN PATENT DOCUMENTS

| | | | |
|---|---|---|---|
| 3222982 | 12/1983 | Fed. Rep. of Germany . | |
| 2335692 | 12/1975 | France | 92/122 |
| 809086 | 2/1959 | United Kingdom | 92/121 |
| 893361 | 4/1962 | United Kingdom . | |

OTHER PUBLICATIONS

"Hydraulic Rotary Motor", *IBM Technical Disclosure Bulletin*, v. 25, No. 9, pp. 4665–4666, IBM Corp. Feb. 1983.

*Primary Examiner*—Robert E. Garrett
*Assistant Examiner*—George Kapsalas
*Attorney, Agent, or Firm*—Dorsey & Whitney

[57] ABSTRACT

A rotary actuator having a housing defining an opening, an output shaft extending through the opening, a stator vane and rotor vane associated with the output shaft and opening to define a plurality of actuation chambers and an inner surface of the housing extending inwardly past a shoulder portion of the output shaft to seal directly against the shaft.

18 Claims, 3 Drawing Sheets

OSCILLATORY ACTUATOR WITH DIRECT CONTACT SHAFT-SHOULDER TO END CAP SEAL

This is a continuation of application Ser. No. 632,719, filed July 20, 1984 now abandoned.

BACKGROUND OF THE INVENTION

The present invention relates generally to the field of rotary actuators and more particularly, to a vane type rotary actuator with an improved means for sealing the pneumatic actuation chambers.

In general, a rotary actuator causes the rotation of an output drive shaft through a fixed arc at relatively high, instantaneous torque and relatively low speed. A vane type rotary actuator includes a housing defining an inner chamber, a drive shaft extending through the inner chamber and at least one stationary (stator) vane and one rotating (rotor) vane defining a plurality of actuation chambers. A single vane rotary actuator comprises a single stator vane connected with the interior of the cylinder wall and a single rotor vane connected with the rotating output shaft. By selectively introducing pressurized pneumatic fluid into and exhausting such fluid from the chambers defined between these vanes, the output shaft is caused to rotate, thus permitting it to drive any device where such rotational movement is desired. A single vane rotary actuator, by its very nature, is limited to a rotational arc of less than 360°.

A double vane rotary actuator, includes a pair of stator vanes a pair of rotor vanes and a pneumatic accuation chamber between each of these vanes. With a double vane rotary actuator, the torque which can be created with a given pressure is significantly increased. The drawback to a double vane rotary actuator as opposed to a single vane is that it is limited to a rotational arc of less than 180°.

One objective in the design and manufacture of all vane type rotary actuators is to provide an effective seal for the accuation chambers so that air or other pneumatic fluid leakage between such chambers can be minimized. One area which has caused particular problems in the manufacture of vane type rotary actuators is the area between the junction of the output shaft, the rotor and stator vane seals and the end cap. In presently existing rotary actuators, this seal is accomplished by an annular end cap seal member which is positioned in an annular groove in the end cap to seal against a portion of the output shaft as well as portions of the stator and rotor vane seals. These end cap seals which have included "O" ring, quad and various other types of seals have rounded corners; thus, there is always a small annular opening between actuation chambers through which leakage can occur. This accordingly reduces the efficiency of the actuator. The prior designs also embody a structure in which a portion of the rotor vane seal engages the end cap seal. This involves contact between one seal member and another, which is normally a rubber to rubber or elastomer to elastomer contact. Because of this contact, the "break away" force, or the force needed to start the vane moving, is quite high and the seal life is quite short.

Accordingly, there is a need in the art for a vane type rotary actuator with improved seal means so as to reduce the "break away" force, increase the seal life and also prevent leakage between the actuation chambers.

SUMMARY OF THE INVENTION

The present invention relates to a vane type rotary actuator which overcomes the deficiencies in the prior art by significantly improving the actuation chamber seals. In the preferred structure of the present invention, all rubber to rubber and elastomer to elastomer contact has been eliminated. This in turn leads to a significant reduction in the "break away" force and a significantly longer seal life. Additionally, the seal means of the present invention virtually eliminates all leakage so that the chambers in the actuator are "bubble tight", thus increasing the efficiency of the actuator.

The specific structure of the rotary actuator of the present invention eliminates the annular groove and corresponding annular seal in the end caps which are common in prior art devices. Instead, the improved structure of the present invention causes a shoulder portion of the output shaft to be sealed directly against an inner surface of the end wall. To accommodate this seal, the end cap is designed with an inner surface which extends inwardly past a portion of the output shaft so that a shoulder portion of such shaft will bear directly against it in sealing relationship. In the preferred embodiment, the inwardmost edge of this inner surface is cantilevered to give it limited flexibility. This permits the inner surface to make contact with the shoulder portion of the output shaft in a sealing relationship.

A further feature of the present invention is the provision of a lip seal to form both the stator and rotor seals and means embodied in one of such seals to preclude undesirable engagement between the lip edges of these seal members during operation. In the preferred embodiment, this stop member includes appropriate bumpers or raised portions disposed on the faces of either the stator or rotor seals.

Accordingly, it is an object of the present invention to provide an improved vane type rotary actuator which reduces the "break away" force, increases the seal life and minimizes the "break away" force, increases the seal life and minimizes leakage between the actuation chambers.

Another object of the present invention is to provide a vane type rotary actuator having an improved seal means which elimiates all rubber to rubber or elastomer to elastomer contact.

A further object of the present invention is to provide a vane type rotary actuator in which a shoulder portion of the output shaft and portions of the end edges of the stator and rotor vane seals all seal against the inner surface of the end caps.

Another object of the present invention is to provide a vane type rotary actuator having lip seals around the perimeter of the stator and rotor vanes and improved means for limiting interference between the lip portions of such seals.

These and other objects of the present invention will become apparent with reference to the drawings, the description of the preferred embodiment, and the appended claims.

DESCRIPTION OF THE PREFERRED EMBODIMENT

Figures 1, 2, 3:
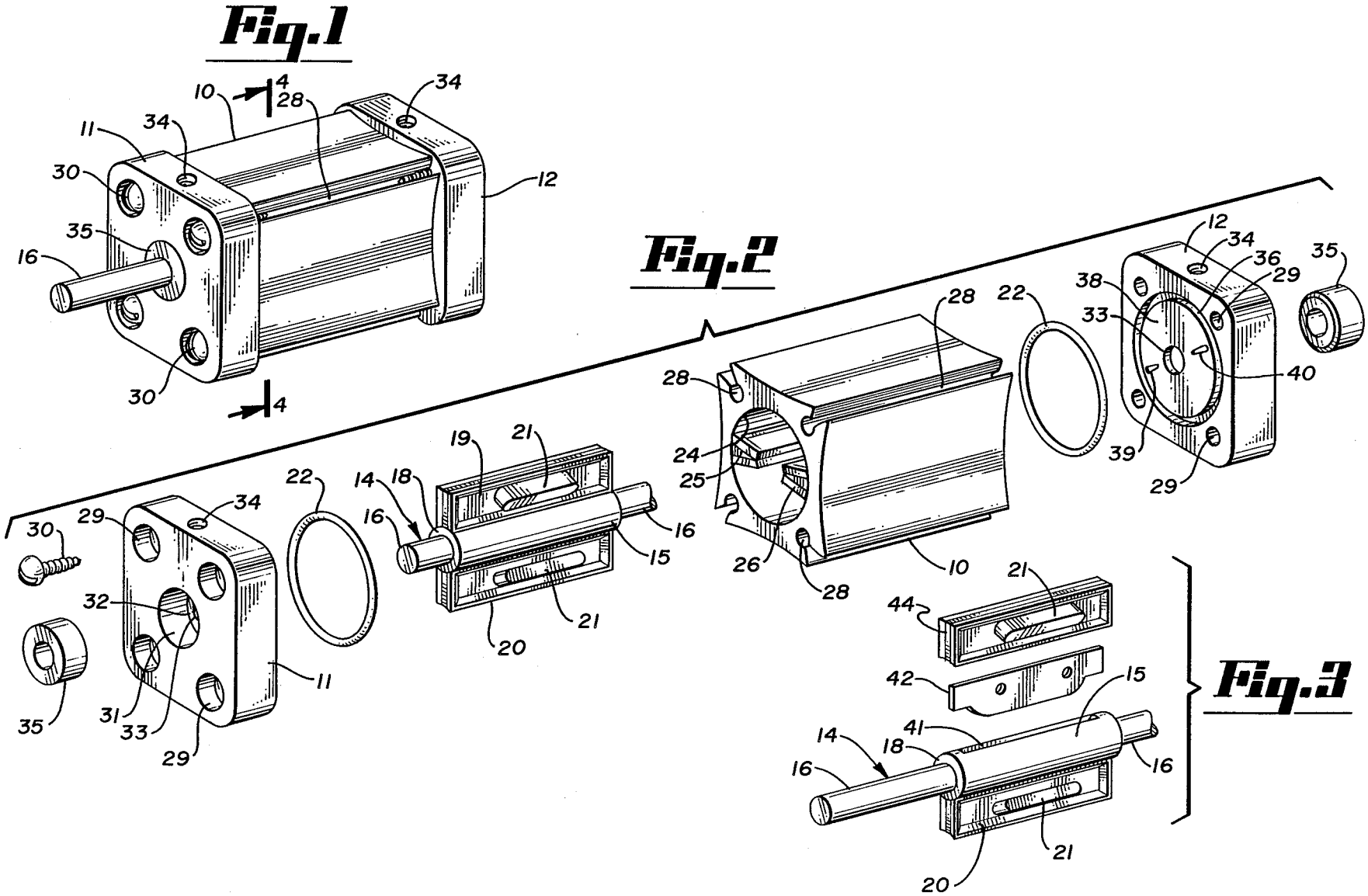
FIG. 1 is a pictorial view of a rotary actuator in accordance with the present invention.
FIG. 2 is a pictorial, broken apart view of the rotary actuator of the present invention.
FIG. 3 is a pictorial broken apart view of the output shaft and associated rotor seals in accordance with the present invention.
Figure 4:
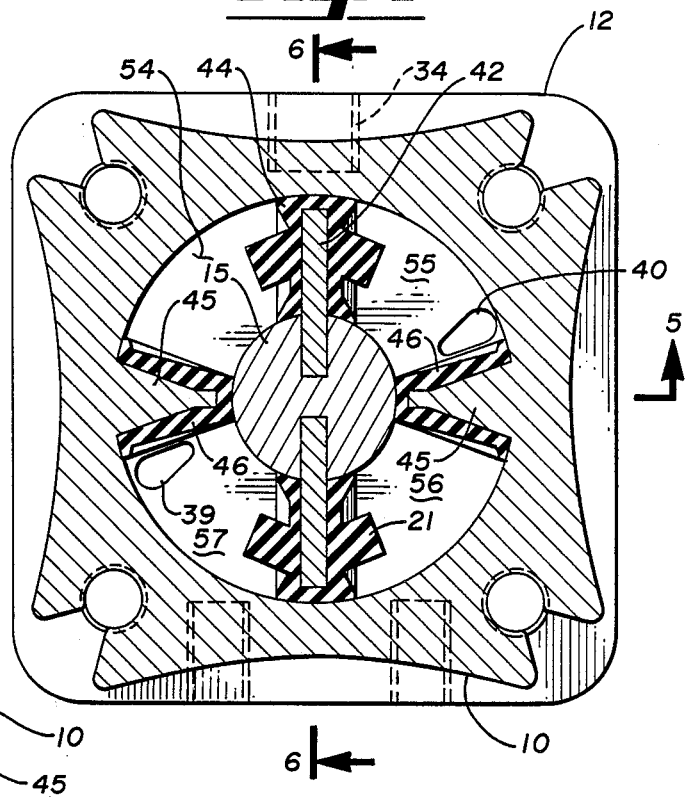
FIG. 4 is a view, partially in section, as taken along the section line 4—4 of FIG. 1.

FIG. 1 is a pictorial view of a rotary actuator in accordance with the present invention. The actuator includes a housing comprising a cylinder portion 10, a pair of end caps 11 and 12 and an end portion 16 of the output shaft. FIG. 2 is a pictorial view of the rotary actuator of the present invention which has been broken apart to show the various internal components. As illustrated, the cylinder portion 10 is sandwiched between the end caps 11 and 12 and includes a generally cylindrically shaped opening 24 extending therethrough in its longitudinal direction. Disposed within the cylindrical opening 24 are a pair of stator vanes comprising a pair of stator seal assemblies 25 and 26. These seal assemblies 25 and 26 engage the inner cylindrical surface of the opening 24 and extend radially inwardly from diametrically opposed positions toward the output shaft 14.

Each of the end caps 11 and 12 includes an annular recessed groove 36 disposed near the outer edge of its inner face. The groove 36 is adapted to receive a conventional "o" ring 22 or other seal member to provide a sealing relationship between the inner surface 38 of each of the end caps 11 and 12 and a respective end face of the cylinder portion 10. Each of the end caps 11 and 12 is provided with a plurality of openings 29 to accept corresponding threaded screws 30 or other connection members to retain the end caps 11 and 12 in sealing relationship against the end faces of the cylinder 10. In the preferred embodiment, the cylinder portion 10 is provided with a groove 28 of generally circular cross sectional configuration along each of its corner edges. Each of the grooves 28 is aligned with one of the openings 29 in the end caps 11 and 12 to threadedly receive the screws 30. The grooves 28 can be provided with internal threads or they can be designed to receive self tapping screws 30 of the type contemplated by the preferred embodiment. The cylinder portion 10 is preferably constructed of a light metal such as aluminum, although various other materials including certain plastics can also be used.

An output shaft 14 is centrally positioned within the cylindrical opening 24 and extends through the cylinder 10. The output shaft includes a central portion 15 of an enlarged diameter and an end section 16 of lesser diameter extending outwardly along the longitudinal axis from each end of the central portion 15. A pair of shoulder portions 18 join the central portion 15 with the end portions 16. Each of the shoulders 18 includes an annular surface which, in the preferred embodiment, is disposed at generally right angles with respect to the longitudinal axis of the shaft 14.

Figure 10:
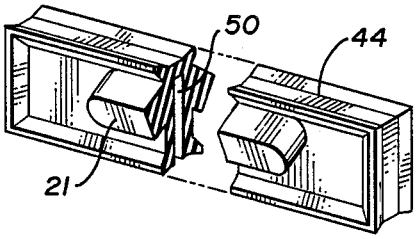
FIG. 10 is a pictorial, split view of one of the rotor seals.
Figure 11:
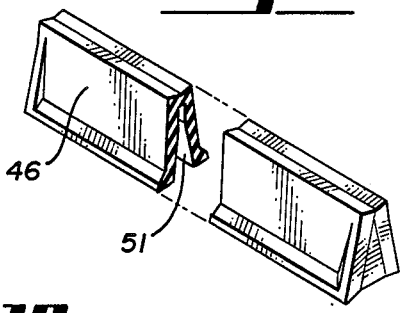
FIG. 11 is a pictorial, split view of one of the stator seals.
Figure 12:
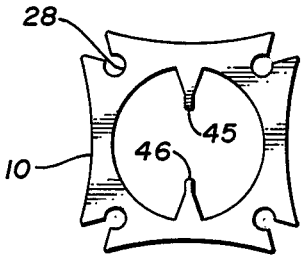
FIG. 12 is an elevational end view of the actuating cylinder portion without the stator seals.

A pair of rotor vanes comprising a pair of rotor seal assemblies 19 and 20 are mounted onto the central portion 15 of the output shaft 14 along its longitudinal axis and on diametrically opposite sides. As illustrated best in FIGS. 3, 4, 6, and 10, each of the rotor vane seal assemblies is comprised of a rigid mounting element 42 and an outer lip seal member 44. The rigid mounting members 42 are secured to the central portion 15 of the output shaft in a longitudinal slot 41 by any appropriate means such as cementing or by press fitting the members 42 into their respective slots 41. FIG. 10 is a pictorial, split view of the lip seal member 44. As shown, the member 44 includes an inner, rectangularly shaped opening 50 which fits over and is secured to the mounting member 42. Disposed on the outer side surfaces of each of the lip seal members 44 is a raised portion or bumper 21 which is adapted for engagement with a side portion of the stator seal. The bumper 21 functions to limit the rotational movement of the output shaft 14 and thus the entire rotor so as to preclude interference or undesirable contact between the lip portions of the rotor seals 19 and 20 and the stator seals 25 and 26. The lip seal members 44 are connected to the mounting member 42 and also to the central portion 15 by appropriate adhesive or vulcanization means. When fully assembled, the lip portions of each of the seal members 44 form a sealing relationship with the inner surface of the cylindrical opening 24 and the inner surfaces of the end caps 11 and 12. Although the lip seal member 44 can be constructed from a variety of different materials, the preferred embodiment contemplates the seal member 44 to be constructed of Buna N.

Figure 5:
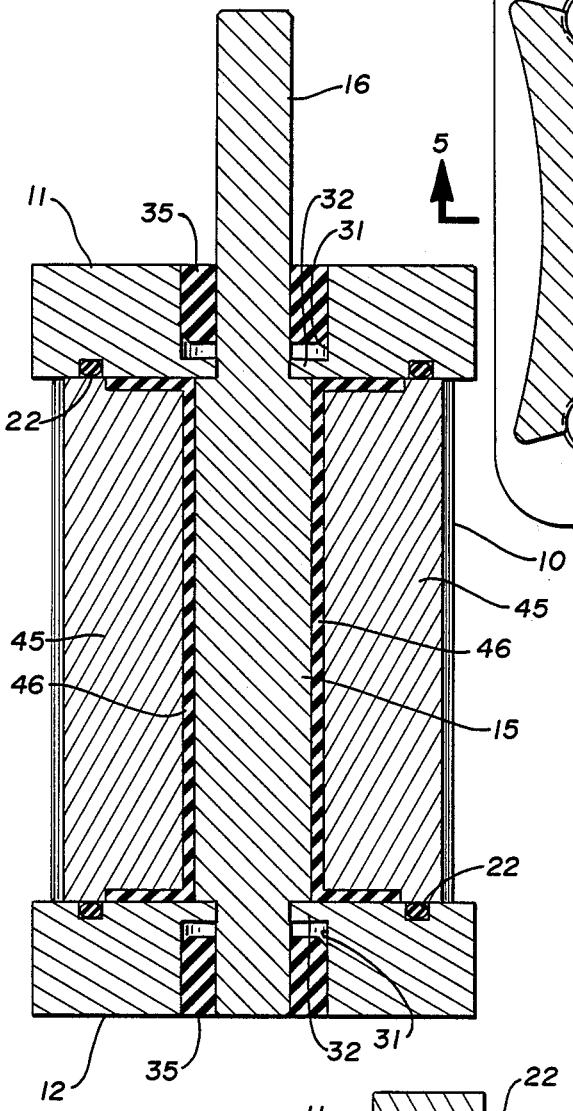
FIG. 5 is a view, partially in section, as viewed along the section line 5—5 of FIG. 4.

As illustrated in FIGS. 4, 5, 11 and 12, each of the stator vane seal assemblies 25 and 26 is comprised of an inner support member 45 integrally formed with the cylinder 10 and an outer lip seal member 46. The support portions 45 are diametrically opposed to each other and extend in a longitudinal direction along an inner surface of the cylindrical opening 24. As illustrated in FIG. 5, the ends of the support member 45 do not extend all the way to the end face of the cylinder 10, but are spaced inwardly therefrom to accommodate the lip seal member 46. The structure of the lip seal member 46 is shown best in FIGS. 4 and 11. The lip seal member 46 includes a central groove 51 corresponding substantially in shape and size to the cross sectional configuration of the support member 45, thus permitting the member 46 to be placed over and retained by the support 45. The seal 46 is retained in this position by the shaft 15. An appropriate adhesive or other means may also be used. When so positioned, the lip portions of the seal 46 form a sealing relationship with the inner surface of the opening 24, the central portion 15 of the shaft 14 and the inner end surfaces of the end caps 11 and 12.

Figure 9:
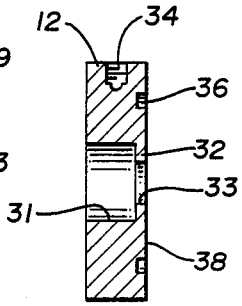
FIG. 9 is a view, partially in section, as viewed along the section line 9—9 of FIG. 8.
Figure 13:
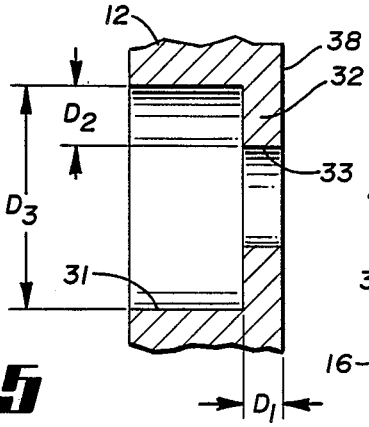
FIG. 13 is an enlarged sectional view of a portion of the end cap in accordance with the preferred embodiment of the present invention.

The structure of the end caps 11 and 12 is illustrated best in FIGS. 1, 7, 8, 9 and 13. As described above, each of the end caps 11 and 12 includes a plurality of openings 29 to facilitate connection of the end caps to the cylinder portion 10. Each of the end caps 11 and 12 is also provided with a pair of openings or ports 39 and 40 on the inner surface 38 (FIGS. 2 and 7) which are in communication with the interior of the pneumatic actuation chambers when the actuator is assembled. As illustrated best in FIG. 7, each of these ports 39 and 40 is directly connected by passages 48 and 49, respectively, to a supply and exhaust port 34. As shown in FIGS. 2, 9 and 13, the inner surface 38 of each of the end caps 11 and 12 extends inwardly toward the shaft 14 to a centrally positioned circular opening 33. The portion of this inner surface 38 adjacent to the opening 33 forms the inner side surface of an annular portion 32 in each of the end caps 11 and 12. This annular portion 32 extends radially inwardly from the main body portion of the end cap and is defined at its innermost edge by the opening 33. The inner surface of this annular portion 32 forms a sealing surface for engagement by the shoulder 18 of the shaft 14.

Each of the end caps also includes a counterbore 31 into which a bearing member 35 is seated. In the preferred embodiment, the counterbore 31 extends inwardly to the annular portion 32 and has a diameter of $D_3$ (FIG. 13). The diameter $D_3$ is preferably greater than the diameter of the central portion 15 of the shaft to allow the portion 32 to flex slightly when engaged by the shoulder portion 18 of the shaft. The bearing 35 is press fit into the bore 31 and includes a central opening to rotatably support the end portion 16 of the output or drive shaft 14. The dimension $D_2$ shown in FIG. 13 defines the radial dimension of the annular portion 32, while the dimension $D_1$ defines the longitudinal dimension of the portion 32.

To provide the benefits of the present invention, the innermost edge of the annular portion 32 (defined by the opening 33) has a diameter slightly larger than the diameter of the end portion 16 of the shaft 14, but a diameter less than the diameter of the central portion 15. This allows the end portions 16 to rotate freely within the openings 33 and the shoulder portion 18 of the output shaft to engage the inner surface of the portion 32 in a sealing relationship when the unit is assembled. This relationship is illustrated best in FIGS. 5 and 6.

In the preferred embodiment, the length of the central portion 15 of the shaft 14 is slightly longer than the length of the cylinder portion 30. Thus, when the end caps 11 and 12 are connected with the cylinder portion 30, the inwardly extending annular portions 32 will be squeezed against the shoulder portion 18, thus forming a sealing relationship between the shoulder 18 and the portion 32. In the preferred embodiment, the cylinder 30 is approximately 1.761 inches, whereas the central portion 15 is approximately 0.005 inches longer. Because of this difference in length, the annular portions 32 are slightly flexed as the end caps 11 and 12 are secured to the cylinder portion 30. Thus, the annular portions 32 must be capable of accommodating this flexing. Although the annular portion 32 can have various dimensional configurations, the preferred embodiment contemplates a structure in which the longitudinal dimension $D_1$ of the portion 32 is less than the radial dimension $D_2$. The portion 32 should also be constructed of a material which permits the above flexing. Although various metals and other materials will function satisfactorily, the preferred embodiment contemplated the end caps to be constructed of a hard plastic such as nylon.

When fully assembled, the shaft 14 with its rotor seal assemblies 19 and 20 is inserted into the cylindrical opening 24 in the cylinder portion 10. The "O" rings 22, 22 are then inserted in the corresponding grooves 36 on the inside surface of the end plates 11 and 12 and the end plates are secured to the end faces of the cylinder portion 10 by the screws 30. As the screws are tightened, the inner surface of the annular portion 32 (FIGS. 9 and 13) is biased against the shoulder portions 18 of the shaft 14 in a sealing relationship. The end portions 16 of the shaft are rotatably supported by the bearing members 35.

In its fully assembled condition, a plurality of actuation chambers are formed within the cylinder portion 10 between the various stator and rotor vanes. These chambers 54, 55, 56 and 57 are illustrated best in FIG. 4. During operation of the rotary actuator, pressurized pneumatic fluid such as air is alternately supplied to and exhausted from these chambers throught the ports 39 and 40 and corresponding supply and exhaust openings 34. When pressurized pneumatic fluid is introduced into the chambers 55 and 57 through the ports 39 and 40 and the opening 34 in the end cap 12, the shaft 14 will be caused to rotate in a counterclockwise direction as viewed in FIG. 4. When the shaft reaches the end of its counterclockwise rotational movement as defined by engagement between the bumpers 21 and the side surfaces of the stator seal 46, appropriate valving will cause the fluid in the chambers 55 and 57 to be exhausted through the ports 39 and 40 and the opening 34 in the end cap 12. At the same time pressurized fluid will be introduced into corresponding ports 39 and 40 and openings 34 in the end cap 11. It should be noted that the opening 34 and the ports 39 and 40 in the end cap 11 are in communication with the actuation chambers 54 and 56. The supply of pressure to these chambers will cause the shaft 14 to rotate in a clockwise direction.

Figure 6:
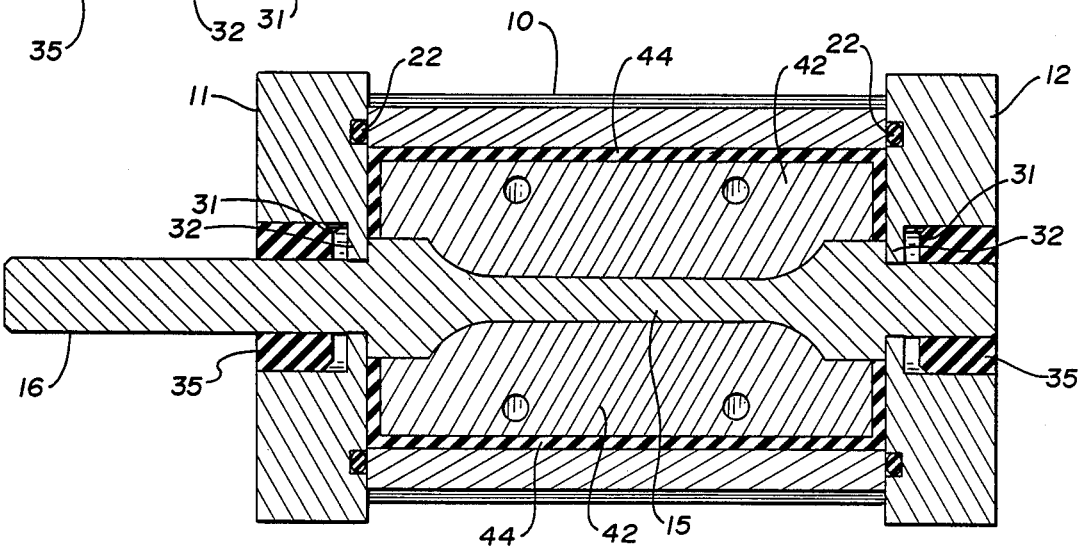
FIG. 6 is a view, partially in section, as viewed along the section line 6—6 of FIG. 4.
Figure 7:
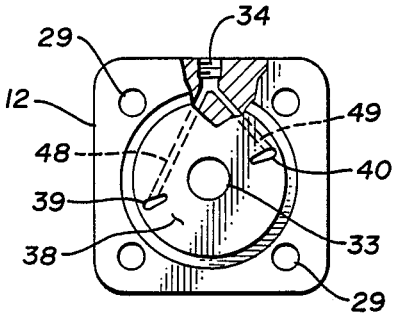
FIG. 7 is an elevational view, with portions broken away, of the inside surface of one of the end caps.
Figure 8:
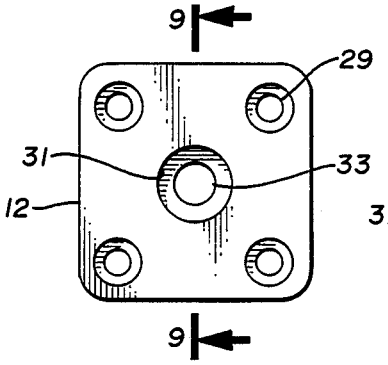
FIG. 8 is an elevational view of the outer surface of one of the end caps.

As illustrated best in FIGS. 5 and 6, both the side edges of the rotor and stator seal members, reference numerals 44 and 46, respectively, and the shoulder portion 18 of the shaft 14 are in sealing engagement with the inside surface 38 of the end caps 11 and 12. Also, the inner edge of the stator seal members 46 (FIG. 5) and the innermost portion of the side edges of the rotor seal members 44 are in sealing relationship with the central portion 15 of the shaft. This combined seal relationship results in the elimination of any rubber to rubber contact and significantly reduces any leakage between the various actuation chambers, thereby increasing the efficiency of the actuator.

Figure 14:
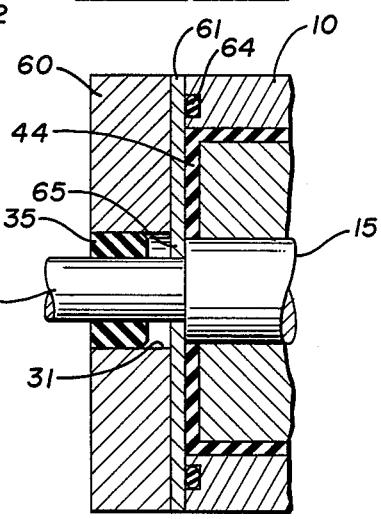
FIG. 14 is a view, partially in section, of one of the end caps and a portion of the output shaft and rotor vane seals showing an alternate embodiment in accordance with the present invention.

It is contemplated that various modifications and alternate embodiments can be designed which are different from the preferred embodiment described above, but nevertheless, still incorporate the novel features of the present invention. For example, FIG. 14 illustrates one such alternate embodiment. In FIG. 14, the end cap assembly includes an end cap support member 60 and an adjacent end cap seal plate 61. In this embodiment, a groove is formed in the end surface of the cylinder 10 and an "O" ring 64 is positioned therein to seal against the inside surface of the plate 61. The plate 61 extends inwardly past the center bore 31. This forms an inwardly extending annular portion 65 for sealing relationship with the central portion 15 of the output shaft. The shaft is rotatably supported at each of its ends 16 by an appropriate bearing 35.

Figure 15:
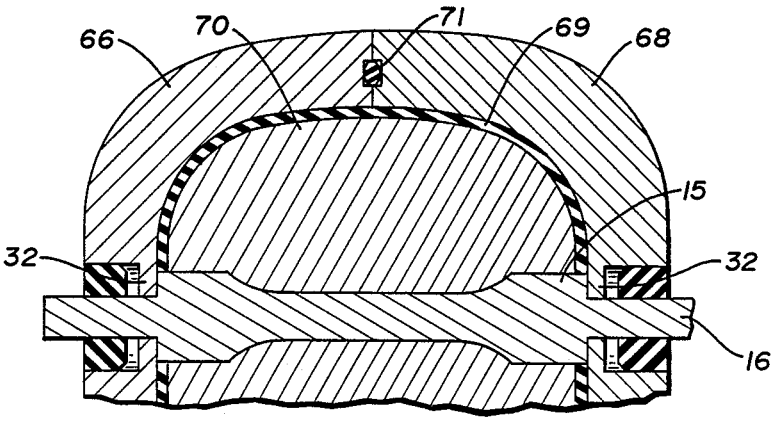
FIG. 15 is a view, partially in section, of a further embodiment of the present invention.

An alternate structure is also contemplated which has no separate end caps or cylinder portion, but which includes actuation chambers having a cross sectional configuration of a semi-circle, a semi-elipse or some other configuration such as that illustrated in FIG. 15. In this embodiment, an "o" ring 71 is disposed between a pair of housing sections 66 and 68. The output shaft includes a central portion 15 and a pair of end portions 16. A pair of rotor seals 69 and supports 70 are connected with the central portion of the shaft 15 and are configured to conform with the inner surface of the housing sections 66 and 68. The inner surface defined by the sections 66 and 68 is symmetrical and includes an inner annular portion 32 for sealing engagement with the central portion 15 of the output shaft.

Accordingly, it is intended that the scope of the present invention be dictated by the appended claims rather than by the description of the preferred embodiment.

I claim:

1. A rotary actuator comprising:

a housing having a generally cylindrical opening formed therein, said opening being defined on its sides by an inner cylindrical surface and on its ends by a pair of spaced, generally parallel end surfaces, each of said end surfaces extending inwardly from said inner cylindrical surface to a center opening and each of said end surfaces being continuous such that each of said end surfaces lies in a single plane generally perpendicular to said inner cylindrical surface;

a centrally disposed shaft extending through said cylindrical opening, said shaft having a central portion comprising a pair of ends and being disposed within said cylindrical opening and between said end surfaces, said shaft further having a pair of end portions extending outwardly from the ends of said central portion along the longitudinal axis of said shaft and through said center openings, the ends of said central portion having a diameter greater than the diameter of said end portions and greater than the diameter of said center openings and said end portions having a diameter less than the diameter of said center opening, said shaft further including a pair of shoulder portions joining the ends of said central portion and said end portions, each of said shoulder portions comprising a generally annular sealing surface being disposed generally perpendicular to the longitudinal axis of said shaft and having an outer edge defined by intersection with a repsective end of said central portion for direct sealing engagement with a portion of said end surfaces;

at lesast one stator vane member connected with said inner cylindrical surface and having first seal means for sealing engagement with said end surfaces and said central portion of said shaft;

at least one rotor vane member connected with said central portion of said shaft and having a second seal means for sealing engagement with said end surfaces and said inner cylindrical surface, said second seal member extending along the periphery of said rotor vane member and terminating at the outer edge of said annular sealing surface;

an actuation chamber defined between each of said stator and rotor vane members;

means for introducing pressurized fluid into and exhausting pressurized fluid from said actuation chambers; and a pair of end caps each embodying one of said end surfaces and center openings wherein each of said end surfaces includes an inner end sealing portion adjacent to, and extending radially outwardly from, its respective center opening and adapted for limited deflection as a result of direct sealing engagement by said annular sealing surface, each of said end caps further including a bore portion lying on an axis common with the axis of said center openings, said bore portin being longitudinally adjacent to said inner end sealing portion and having a diameter greater than the diameter of the ends of said central portion of said shaft to thereby permit the limited deflection of said inner end sealing portion.

2. The rotary actuator of claim 1 wherein each of said end caps includes an outer surface generally parallel to its end surface and said bore portion extends inwardly from said outer surface toward said end surface.

3. The rotary actuator of claim 2 including a bearing disposed in said bore portion of each of said end caps for rotatably supporting said end portions of said shaft.

4. The rotary actuator of claim 1 wherein said housing includes a tubular section disposed between said end caps, said tubular section having a length less than the length of said central portion so as to create a sealing force between said shoulder portions and said end surfaces.

5. The rotary actuator of claim 1 wherein said end caps are constructed of a synthetic, plastic material.

6. The rotary actuator of claim 5 wherein said end caps are constructed of nylon.

7. The rotary actuator of claim 1 wherein said first and second seal means are lip seal means.

8. The rotary actuator of claim 7 wherein at least one of said first and second seal means includes a raised portion to prevent interference between the edges of said first and second lip seal means.

9. The rotary actuator of claim 1 wherein the distance between said end surfaces is less than the length of said central portion so as to cause limited deflection of that portion of said end surfaces adjacent to said center opening.

10. The rotary actuator of claim 1 wherein said inner end sealing portion extends radially inwardly of said bore portion a distance greater than the dimension of said end sealing portion in a direction along the longitudinal axis of said actuator.

11. A rotary actuator comprising:

a housing having a chamber formed therein, said chamber being defined by an inner surface;

a pair of shaft openings on diametrically oppoisite ends of said chamber;

a shaft having a central portion comprising a pair of ends and being disposed within said chamber, a pair of end portions extending outwardly from said central portion and through said shaft openings and a shoulder portion joining each of said end portions with said central portion, the ends of said central portion having a diameter greater than the diameter of said shaft openings and said end portions, each of said shoulder portions including a generally annular sealing surface extending between said central portion and its respective end portion for direct sealing engagement with that portion of said inner surface adjacent to, and radially outwardly from, said shaft openings;

at least one stator vane connected with said inner surface and having first seal means for sealing engagement with said central portion of said shaft;

at least one rotor vane connected with said central portion of said shaft and having second seal means for sealing engagement with said inner surface, said second seal member extending along the periphery of said rotor vane member and terminating at the outer edge of said annular sealing surface;

an actuation chamber defined between each of said stator and rotor vane members;

means for selectively introducing pressurized fluid into and exhausting pressurized fluid from said actuation chambers; and an inner end sealing portion and a bore portion embodied within said housing, said inner end sealing portion being adjacent to, and extending radially outwardly from, said shaft opening and adapted for limited deflection as a result of direct sealing engagement by said annular sealing surface, said inner end sealing portion further forming a continuous portion of said inner surface, and said bore portion lying on an axis common with the axis of said center opening, said bore portion being longitudinally adjacent to said inner end sealing portion and having a diameter greater than the diameter of the ends of said central portion of said shaft to thereby permit the limited deflection of said inner end sealing portion.

12. The rotary actuator of claim 11 wherein said chamber is symmetrical and includes an axis of symmetry and wherein said shaft openings are concentric with said axis of symmetry.

13. The rotary actuator of claim 12 including a bearing disposed in said bore portions of each of said end caps for rotatably supporting said end portions of said shaft.

14. The rotary actuator of claim 11 wherein said housing is constructed of a synthetic plastic material.

15. The rotary actuator of claim 14 wherein said housing is constructed of nylon.

16. The rotary actuator of claim 11 wherein said first and second seal means are lip seal means.

17. The rotary actuator of claim 16 wherein at least one of said first and second seal means includes a raised portion to prevent interference between the edges of said first and second lip seal means.

18. The rotary actuator of claim 11 wherein said inner end sealing portion extends radially inwardly of said bore portion a distance greater than the dimension of said end sealing portion in a direction along the longitudinal axis of said actuator.

* * * * *